US008672727B2

(12) United States Patent
LaRoux

(10) Patent No.: US 8,672,727 B2
(45) Date of Patent: Mar. 18, 2014

(54) SYSTEM FOR ADJUSTING THE FIT OF A BRA TO A WEARER'S BOSOM

(76) Inventor: Sharon T. LaRoux, Heath, TX (US)

( * ) Notice: Subject to any disclaimer, the term of this patent is extended or adjusted under 35 U.S.C. 154(b) by 30 days.

(21) Appl. No.: 13/136,554

(22) Filed: Aug. 4, 2011

(65) Prior Publication Data

US 2012/0034841 A1 Feb. 9, 2012

Related U.S. Application Data

(60) Provisional application No. 61/400,877, filed on Aug. 4, 2010.

(51) Int. Cl.
*A41C 1/14* (2006.01)
*A41C 3/12* (2006.01)

(52) U.S. Cl.
USPC ..... 450/41; 450/49; 450/51; 450/52

(58) Field of Classification Search
USPC ..... 450/41, 42, 45, 46, 47, 49, 51, 52
See application file for complete search history.

(56) References Cited

U.S. PATENT DOCUMENTS

| | | | | |
|---|---|---|---|---|
| 4,203,449 | A * | 5/1980 | Winzelberg | 450/49 |
| 6,206,753 | B1 * | 3/2001 | Werner | 450/41 |
| 6,468,130 | B1 * | 10/2002 | Thakur et al. | 450/41 |
| 6,761,612 | B1 * | 7/2004 | Pencil et al. | 446/310 |
| 6,761,613 | B2 * | 7/2004 | Utaka | 450/41 |
| 6,857,933 | B2 * | 2/2005 | Horta et al. | 450/41 |
| 7,841,924 | B2 * | 11/2010 | Wan | 450/41 |

* cited by examiner

*Primary Examiner* — Gloria Hale
(74) *Attorney, Agent, or Firm* — Jeffrey Roddy

(57) ABSTRACT

A system for adjusting the fit of a bra includes a bra having cups, a bridge therebetween, and an underwire channel sewn beneath each cup. The underwire residing in each channel is bendable along at least one axis, can be lengthened, and is capable of retaining its adjusted shape after being adjusted.

4 Claims, 3 Drawing Sheets

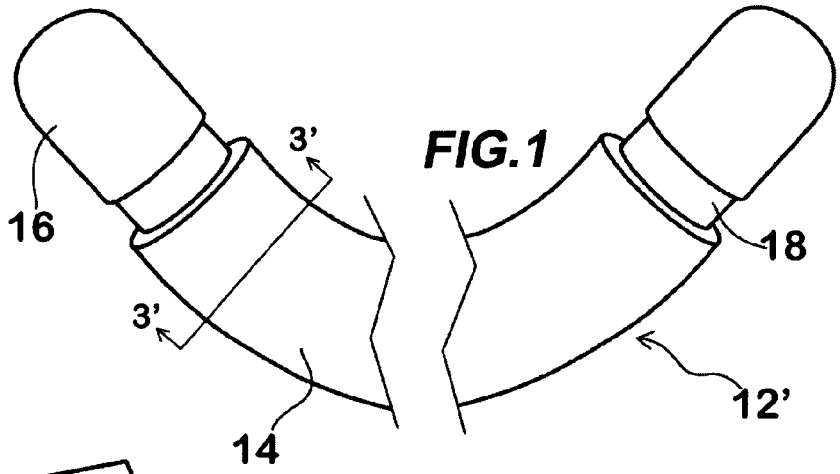
FIG.1
FIG.2
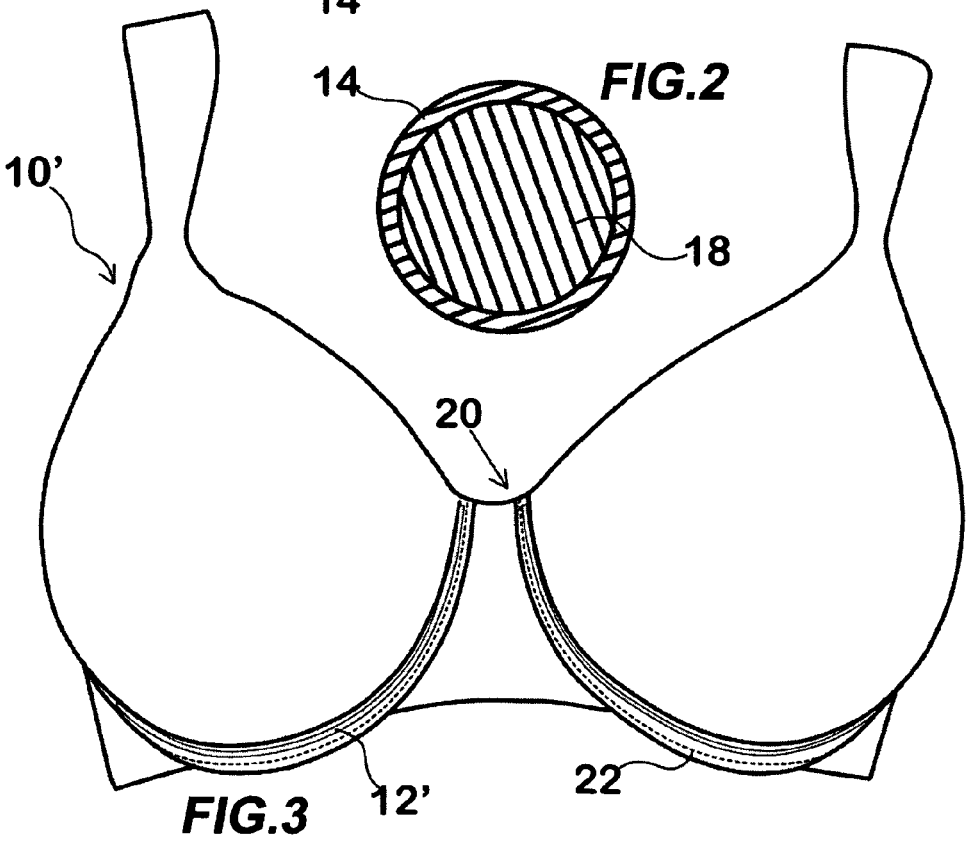
FIG.3

SYSTEM FOR ADJUSTING THE FIT OF A BRA TO A WEARER'S BOSOM

CROSS REFERENCE TO RELATED APPLICATIONS

This application claims the benefit of Provisional Patent Application No. 61/400,877 filed Aug. 4, 2010.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

The present invention relates generally to undergarments and in particular bras having underwire support means. Underwire bras have a wire sewn in at the bottom of each cup to lift and provide support for a woman's breasts. Typically, it is made of plastic coated metal that is flat, flexible along one axis and has memory so that it may retain its preformed shape. The wire is tightly sewn into a wire channel somewhat like a sleeve that circles the bottom and sides of each cup. In correctly constructed bras, as the cup size increases, the underwire gets wider in order to support the entire breast, extending all the way back to below the underarm. However, because women's breasts come in a variety of shapes, sizes, distances apart and height on the torso, and moreover, are subject to changes relating to weight gain, the sizing of bras becomes increasingly challenging. Ill fitting underwires are frequently cited as the part of a bra causing the most discomfort. For example, a too-short underwire will dig into the lower part of the breast and poke sensitive underarm tissue.

It would be desirable to equip bras with an adjustable underwire that can at least bend so that a wearer can adjust to their needs and fit.

SUMMARY OF THE INVENTION

The present invention includes a system for adjusting the fit of a bra, which includes a bra with an adjustable underwire which is bendable by the wearer in order to provide optimal comfort with the bra. In the preferred embodiment, the underwire is a core of malleable metal inside a tube of dissimilar metal or an overlay of an elastomer such as hard plastic or rubber. Each underwire is sewn into a wire channel or sleeve beneath the cups. The channel containing the underwire narrows at the nexus of each cup where it connect to the bridge of the bra. The narrowing restricts one end of the underwire from longitudinal or lateral movement. Slight pivoting at the narrowing may be permitted according to the particular embodiment. The wire channel possess a consistent inside diameter, or widen at the opposite side of the cup adjacent the wearer's axilla to permit lateral movement so that a wearer may bend, and thus lengthen the wire for best fit.

In one aspect according to the present invention, the underwire possesses a flexible wire with a tubular sleeve or coating thereabout. The inner wire and the tubular sleeve may be bent limiting the amount of telescopic travel. Depending on the materials of the wire and sleeve, it is possible that the bendable wire may be able to move slightly longitudinally. Preferably, at least one end of the wire is capped with a blunt plastic cap, or otherwise coated to prevent a pointed protrusion. The cylindrically shaped wire can bend with the tubular sleeve along all axes.

In another aspect according to the present invention, the underwire includes a non-cylindrical shape partially transected with regularly spaced slits. In this case, the underwire can only bend along one axis.

In yet another aspect according to the present invention, the underwire includes an inner core that is a rectangular solid with or without transverse slits, with an outer sleeve that is a compressed ovoid.

In still another aspect according to the present invention, the underwire includes a generally cylindrical inner core residing within a generally ovoid sleeve. In this case, the inner core is freely bendable about only one axis, but has only limited flexibility along another axis.

In all cases, while purposeful bending is permitted by a wearer, the underwire offers sufficient resistance to unintended deformation making adjustments unnecessary under normal circumstances. The narrowing of the wire channel at one end partially immobilizes the underwire at the nexus of the underwire and the bridge. The channel is sewn with a predetermined amount of play between the channel and the underwire which permits the wire to be formed, bent and manipulated within the channel by the wearer to best fit their body shape. Once the underwire is bent to shape, the end that is immobilized by the channel tends to retain the underwire in the modified position under the cup.

It is anticipated that the present invention may be incorporated into bras, swimwear, exercise wear, therapeutic garments and supports of various kinds, as well as an aid used in the custom fitting and tailoring of bras.

One object of the present invention is to provide a means for adjusting the underwire of a bra or other support top to obtain optimal comfort for the breasts.

Another object of the present invention is to provide a means to adjust the underwire of a bra or top for best fit and outward appearance of the bosom.

Still another object of the present invention is to provide a means to adjust the underwire of a bra or top in order to obtain the most support for each breast.

Yet another object of the present invention is to provide a bra with underwire adjustment means that can be incorporated into swimwear, exercise wear, or any other garment.

Other objects and advantages of the present invention will become apparent from the following descriptions, taken in connection with the accompanying drawings, wherein by way of illustration and example, a preferred embodiment of the present invention is disclosed.

BRIEF DESCRIPTION OF THE DRAWINGS

FIG. 1 is a side elevation view of one preferred embodiment according to the present invention;

FIG. 2 is a sectional view taken along lines 3'-3' of FIG. 1;

FIG. 3 is plan view of a bra with the incorporating the preferred embodiment with a tapering wire channel 22;

DETAILED DESCRIPTION OF THE INVENTION

Figure 4:
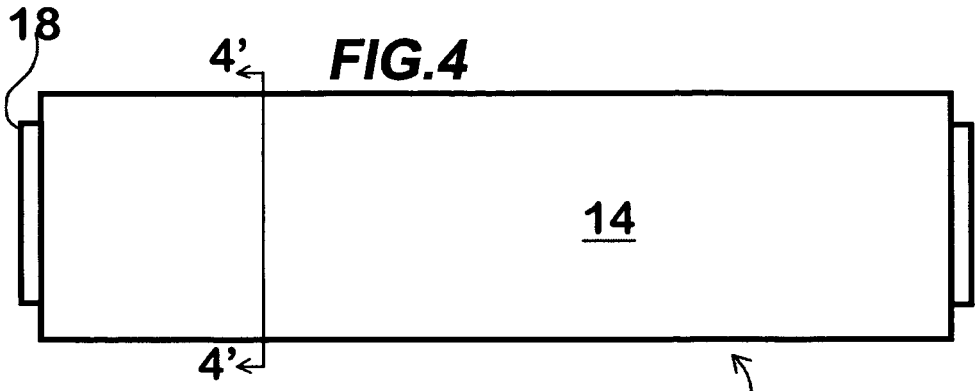
FIG. 4 is a plan view of another embodiment according to the present invention.

Reference listing:

10 bra with underwire
12 underwire
14 outer sleeve
16 end cap
18 inner core
20 bridge of bra
22 stitchline wire channel
23 join of segmented inner core
24 section line of segmented inner core Referring generally to FIGS. 1-11; a preferred embodiment of the present invention is shown as a bra 10 with an special underwire 12, the underwire having an inner core 18 and an outer sleeve 14. The inner core resides within the sleeve 14 protruding at either end and is preferably capped 16. The outer sleeve and the inner core are bendable to shape the underwire in order to obtain the best fit for the breasts. The underwire is flexible enough to be formed by the hands, while stiff enough to retain its shape while being worn. A sewn wire channel beneath each cup secures the underwire so that the underwire is prevented from anything but pivoting movement at the nexus of the bra bridge and the wire channel snugly sewn about the underwire at that point. As indicated by stitch line 22 extending away from the bra bridge, the wire channel slightly widens about the base of the cup and around the side of the cup toward the armpit allowing the underwire to be adjusted within the bounds of the channel. Preferably, the wire is a malleable metal such as an aluminum alloy while the sleeve is a flexible material such as a fabric, a foam, a plastic or an elastomer, or any combination of the foregoing mateials. If a fabric is used, it is preferably padded. If an elastomer is used for the sleeve, depending on the shape of the sleeve, the sleeve, having some bias, will modify the bending characteristics of the wire. If a non-elastomeric plastic is used, the outer sleeve will simply rely on the inner wire to retain its post adjustment shape. It is conceivable that the clearance between the sleeve and the inner wire may allow some limited longitudinal extension of the inner wire. The underwire is capable of lateral adjustment which is only limited by the play permitted between the underwire and the dimensions of the wire channel which is generally arcuate in shape, and possesses a relatively narrow end and relatively wider end.

Figure 5:
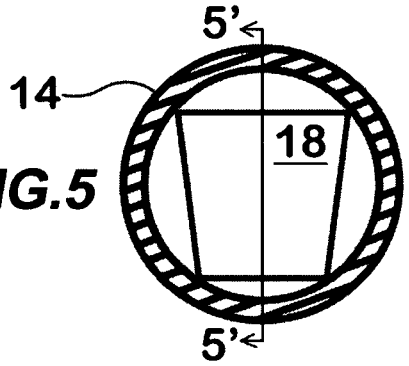
FIG. 5 is a sectional view of one embodiment according to the present invention taken along lines 4'-4' of FIG. 4.
Figure 6:
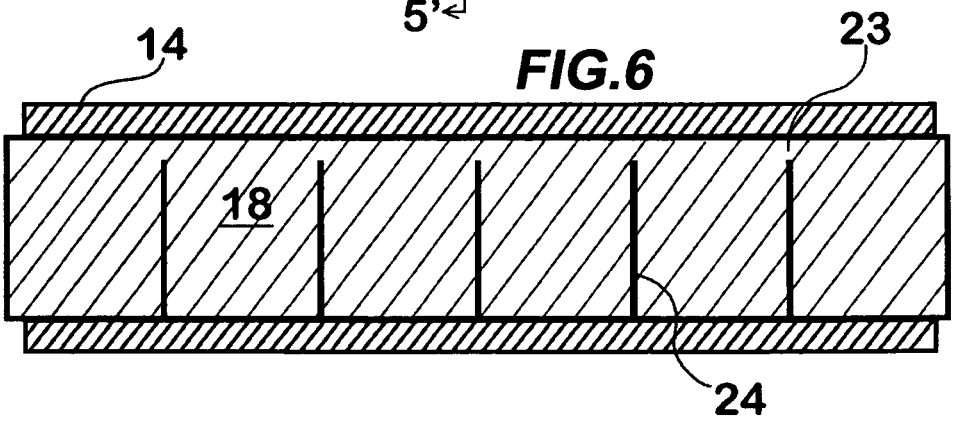
FIG. 6 is a sectional view taken along lines 5'-5' of FIG. 5.
Figure 7:
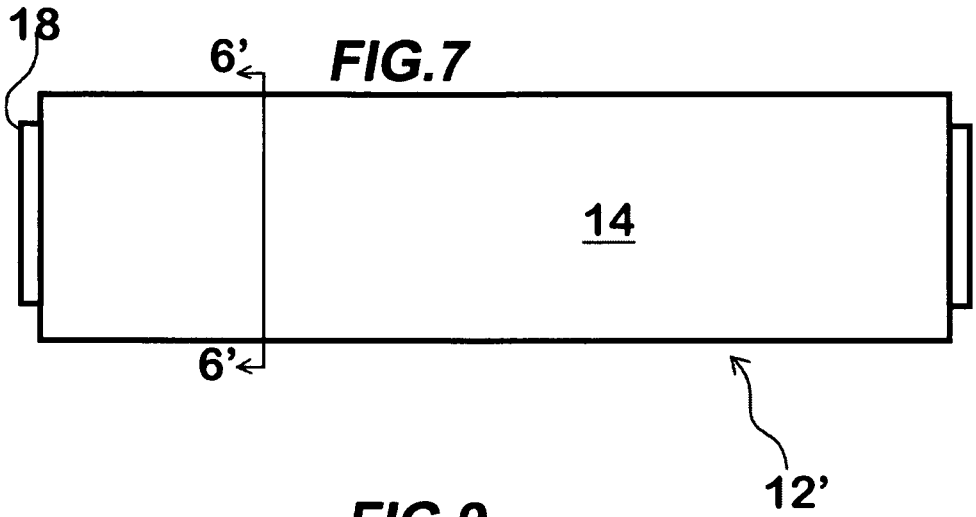
FIG. 7 is a plan view of another embodiment according to the present invention.
Figure 8:
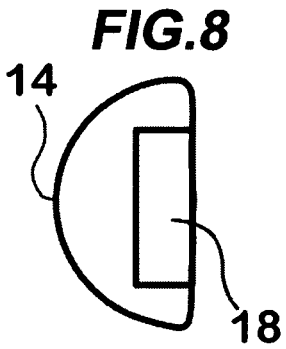
FIG. 8 is a sectional view of one embodiment according to the present invention taken along lines 6'-6' of FIG. 7 in which the core is a sectioned rectangular solid.
Figure 9:
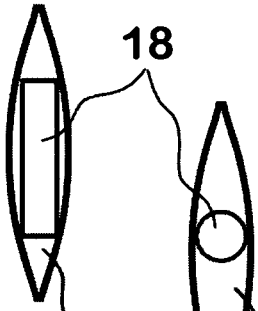
FIG. 9 is a sectional view of one embodiment according to the present invention taken along lines 6'-6' of FIG. 7 in which the core is a sectioned cylindrical solid.
Figure 10:
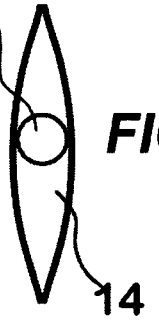
FIG. 10 is a sectional view of one embodiment according to the present invention taken along lines 6'-6' of FIG. 7 in which the core is a partially sectioned rectangular solid.

The inner core of each underwire can be a cylindrical solid such as a metallic wire or rod of sufficient thickness, or a partially sectioned non-cylindrical metallic solid such as depicted in FIGS. 4-6. The inner wire can be a cylindrical or a rectangular plastic rod having a bendable metal core. The wire can be sectioned or unsectioned.

The inner cores depicted in FIGS. 5 and 6, are described as partially sectioned because sections 24 do not completely separate the section terminating at 23. A partially sectioned rectangular solid shape allows the inner core to bend along one axis as opposed to an the unsectioned cylindrical inner core which is permitted to bend in all directions.

As depicted in FIGS. 7-10, the outer sleeve can be cylindrical, rectangular, ovoid, or any shape that will lend comfort to the wearer. When the outer sleeve is a non-cylindrical shape, the bending axes of the inner core can be affected. If the outer sleeve is ovoid, bending may be restricted to one axis regardless of the shape of the inner core. The exterior shape of the underwire does not however, affect the capability of the underwire to be lengthened.

FIG. 3 shows the underwire 12 positioned relative to the bra cup, and seam 22 indicating a narrowing of the wire channel at the bra bridge 20, and a widening of the wire channel as it extends around the cup to the underarm area.

Figure 11:
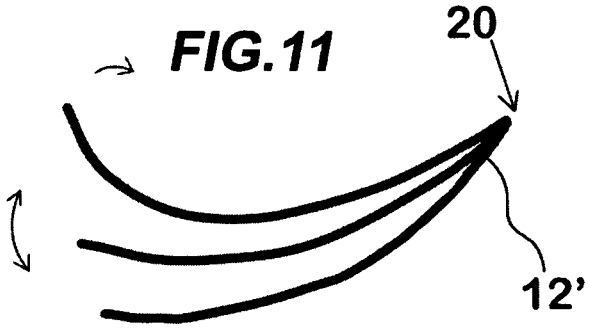
FIG. 11 is a diagrammatic view indicating how the underwire is held in place at one end 20 and bendable along its length within a tapering wire channel.

FIG. 11 diagrammatically depicts the underwire successively bent in three shapes, in which 20 points to the nexus of the wire channel and the bra bridge. The underwire has a greater degree of shape potential at the distal ends owing to the tapering wire channel.

While the invention has been described by the embodiments given, it is not intended to limit the scope of the invention to the particular form set forth. For example, the invention is considered to include any use of the disclosed underwire and channel configuration integrated into an article of clothing in which the integration yields a structure analogous to a bra. The invention is considered to encompass any bra having the disclosed adjustment means incorporated therein, including bras having an adjustable bra band at the back using hook and eye sizing means, or any other size adjustment means. Accordingly, the disclosure is intended to encompass such alternatives, modifications, and equivalents as may be included within the spirit and scope of the invention as defined by the foregoing specification.

What is claimed is:

1. A system for adjusting the fit of a bra to a wearer's bosom, comprising:

a bra having cups and a bridge, a channel included beneath each cup having a narrowing at a portion of the cup joining to the bridge, and a widening at a portion of the cup adjacent the wearer's axilla; and, a bendable underwire residing within each channel, wherein a first end of the underwire is secured at the narrowing portion and is thereby restricted from at least vertical longitudinal movement, and a second end of the underwire resides within remainder of the channel and is permitted some east to west or west to east longitudinal movement within the channel.

2. The system of claim 1 in which each channel is arcuate in shape.

3. The system of claim 1 in which the underwire has an inner portion and an outer sleeve.

4. The system of claim 1 in which the underwire retains an adjusted shape after being adjustably bent.

* * * * *